US007965262B2

(12) United States Patent
Dagois

(10) Patent No.: US 7,965,262 B2
(45) Date of Patent: Jun. 21, 2011

(54) DISPLAY DEVICE WITH CAPACITIVE ENERGY RECOVERY

(75) Inventor: Jean-Paul Dagois, Cesson-Sévigné (FR)

(73) Assignee: Thomson Licensing, Boulogne-Billancourt (FR)

( * ) Notice: Subject to any disclaimer, the term of this patent is extended or adjusted under 35 U.S.C. 154(b) by 549 days.

(21) Appl. No.: 10/532,259

(22) PCT Filed: Oct. 17, 2003

(86) PCT No.: PCT/EP03/50732
§ 371 (c)(1),
(2), (4) Date: Nov. 28, 2005

(87) PCT Pub. No.: WO2004/038689
PCT Pub. Date: May 6, 2004

(65) Prior Publication Data

US 2006/0125733 A1 Jun. 15, 2006

(30) Foreign Application Priority Data

Oct. 28, 2002 (FR) ..... 02 13979

(51) Int. Cl.
*G09G 3/30* (2006.01)

(52) U.S. Cl. ..... 345/76; 345/82

(58) Field of Classification Search ..... 345/76, 345/99, 100, 208; 428/690
See application file for complete search history.

(56) References Cited

U.S. PATENT DOCUMENTS 6,121,961 A * 9/2000 Feldman ..... 345/204
6,222,323 B1 * 4/2001 Yamashita et al. ..... 315/169.3
6,229,267 B1 * 5/2001 Ushigusa et al. ..... 315/169.4
6,339,415 B2 1/2002 Ishizuka
6,351,076 B1 2/2002 Yoshida et al.
6,351,255 B1 2/2002 Ishizuka et al.
6,369,516 B1 * 4/2002 Iketsu et al. ..... 315/169.3
6,417,868 B1 * 7/2002 Bock et al. ..... 345/698
6,473,064 B1 10/2002 Tsuchida et al.
6,501,226 B2 * 12/2002 Lai et al. ..... 315/169.1
6,771,235 B2 * 8/2004 Ishizuka et al. ..... 345/77
6,811,896 B2 * 11/2004 Aziz et al. ..... 428/690
6,943,500 B2 * 9/2005 LeChevalier ..... 315/169.3

(Continued)

FOREIGN PATENT DOCUMENTS

EP 1091340 4/2001

(Continued)

OTHER PUBLICATIONS

Search Report Dated Apr. 7, 2004.

*Primary Examiner* — Quan-Zhen Wang
*Assistant Examiner* — Calvin C Ma
(74) *Attorney, Agent, or Firm* — Robert D. Shedd; Harvey D. Fried; Richard LaPeruta

(57) ABSTRACT

Device comprising a display panel, preferably organic electroluminescent with passive matrix, comprising an array of columns and an array of rows of electrodes for powering an array of cells and drivers adapted for successively connecting each row electrode to one of the terminals of the power supply of the panel, and during a sequence of connection of a row electrode, for simultaneously connecting one or more column electrodes to the other terminal of the power supply, and for being able to transfer to each cell to thus be powered the charge of the intrinsic capacitors of the cells linked to the same column electrode as the cell to be powered.

8 Claims, 4 Drawing Sheets

U.S. PATENT DOCUMENTS

| | | | | |
|---|---|---|---|---|
| 7,027,013 | B2 * | 4/2006 | Ouellete et al. | 345/76 |
| 2001/0024186 | A1 * | 9/2001 | Kane et al. | 345/98 |
| 2002/0145380 | A1 | 10/2002 | Aziz et al. | |
| 2003/0025655 | A1 | 2/2003 | Ochi et al. | |

FOREIGN PATENT DOCUMENTS

| | | | |
|---|---|---|---|
| JP | 11-143429 | A | 5/1999 |
| JP | 11-231834 | A | 8/1999 |
| JP | 11-289194 | A | 10/1999 |
| JP | 2000-284721 | A | 10/2000 |
| JP | 2001-109429 | A | 4/2001 |
| JP | 2001-109430 | A | 4/2001 |
| JP | 2001-109431 | A | 4/2001 |
| JP | 2003-43996 | A | 2/2003 |
| KR | 2001-0050818 | A | 6/2001 |

* cited by examiner

DISPLAY DEVICE WITH CAPACITIVE ENERGY RECOVERY

This application claims the benefit, under 35 U.S.C. §365 of International Application PCT/EP03/50732 filed Oct. 17, 2003, which was published in accordance with PCT Article 21(2) on May 6, 2004 in French and which claims the benefit of French patent application No. 0213979, filed Oct. 28, 2002.

BACKGROUND OF THE INVENTION

The invention relates to a device for displaying images comprising:

- an image display panel comprising a first and a second array of electrodes serving an array of electroluminescent cells, where each cell is powered between an electrode of the first array and an electrode of the second array.
- power supply means linked to said arrays of electrodes,
- drive means for each of said cells of the panel, and
- means for processing data of the images to be displayed so as to parameterize said drive means.

The first array of electrodes generally corresponds to columns and the second array to rows: as power supply means use is generally made of a current or voltage generator; the drive means generally comprise column and row drivers which serve to link the power supply means to the arrays of electrodes.

In such panels, the distance separating the two arrays of electrodes is very small; at the level of each cell, this distance corresponds to the thickness of an electroluminescent organic layer which is commonly of the order of 0.1 μm; therefore, the electrical capacitance between the electrodes of the two arrays is significant and the intrinsic capacitance at the level of each cell is therefore high.

Each image to be displayed is divided into pixels, themselves subdivided into as many subpixels as primary colors; to each subpixel is allocated a luminous intensity datum for the image to be displayed; to display an image, each subpixel of the image is assigned to a cell of the panel.

In such a device, the drive means are adapted:

- for successively connecting each electrode of the second array to one of the terminals of the power supply means; these steps of the method correspond to the scanning of the lines of the panel;
- and, during the sequence of connection of an electrode of the second array, for simultaneously connecting electrodes of the first array to the other terminal of the power supply means.

If the duration of the connection of each electrode of the first array or of activation of the column driver depends on the luminous intensity datum attributed to the cell powered via this column, the duration of power supply of a cell corresponds to the width of a voltage or current pulse, and the driving of the panel is then said to be carried out by pulse width modulation, or is of PWM type.

During the displaying of images, each time a cell of the panel is connected and powered, its intrinsic capacitor is charged; at the end of each sequence of connection of an electrode of the second array or of the scanning of a line, all the cells served by this electrode or this line are disconnected, and before passing to the next sequence of connection of another electrode of the second array or of the scanning of another line, all these intrinsic capacitors are discharged so that the luminous intensity of the cells served by this other electrode or other line is not disturbed by the intrinsic charges accumulated during the previous sequence relating to the previous line.

Accordingly, it is know practice to add an intermediate sequence of discharge, for example via shunting means as described in document U.S. Pat. No. 6,339,415—PIONEER; during this intermediate step of discharge, the intrinsic capacitors of the cells of the line that has just been scanned are discharged to earth.

The drawback of such a procedure of driving with intermediate discharge of each line is that the capacitive energy of the intrinsic capacitors is lost.

The document EP 1091340 describes a procedure for capacitive energy recovery which is limited: specifically, the energy originating from a first cell is recovered for the benefit of another cell only if the video signal to be displayed at this other cell is greater than the video signal displayed at the first cell; the drawback of this procedure is that, in the converse case where the video signal is less, the capacitive energy of the first cell is lost.

SUMMARY OF THE INVENTION

The invention is aimed at recovering the capacitive energy in a much more complete manner than in the prior art; more precisely, the invention proposes that the capacitive energy of each cell of a line be recovered so as to reinject it into the cell of the next line on the same column as a function of the image datum for this cell.

Accordingly, a subject of the invention is a device for displaying images comprising:

- an image display panel comprising a first array and a second array of electrodes which serve an array of cells, where each cell is powered between an electrode of the first array and an electrode of the second array effecting between them an intrinsic capacitor $C_i$,
- power supply means for generating a potential difference between two terminals,
- drive means adapted for successively connecting each electrode of the second array to one of the terminals of the power supply means, and, during a sequence of connection of an electrode of the second array, for simultaneously connecting one or more or even all the electrodes of the first array to the other terminal of the power supply means, characterized in that the drive means are adapted for being able, during each sequence of connection of an electrode of the second array, to transfer to the cell powered between each electrode of the first array and this electrode of the second array, the charge of the intrinsic capacitors of the other cells linked to the same electrode of the first array.

Obviously, if these capacitors are not charged, no transfer of charge can occur; conversely, in the case where they are charged, this transfer of charge may only be partial.

The first array generally corresponds to column electrodes and the second array to row electrodes; if we have G rows, there are in general G cells linked to any given electrode of the first array or column; the charge which is thus transferred to a cell at the intersection of a given row and given column, is assumed to have obviously been accumulated during a sequence relating to a previous row during which the cell at the intersection of this previous row but of the same column was connected to the power supply means.

The power supply means of the panel may be a voltage or current generator; they may comprise several generators each assigned to a group of electrodes.

By virtue of this procedure for driving the panel incorporating means of transferring capacitive charge from one drive sequence to another of the panel, a large share of the capacitive energy of the intrinsic capacitors of the cells of the panel is recovered and the efficiency of the display device is substantially improved.

To summarize, a subject of the invention is a device comprising a display panel, preferably organic electroluminescent with passive matrix, comprising an array of columns and an array of rows of electrodes for powering an array of cells and drive means adapted for successively connecting each row electrode to one of the terminals of power supply means of this panel, and during a sequence of connection of a row electrode, for simultaneously connecting one or more column electrodes to the other terminal of the power supply means, and for being able to transfer to each cell to thus be powered the charge of the intrinsic capacitors of the cells linked to the same column electrode as this cell to be powered.

Preferably, these drive means are adapted so that, during each sequence of connection of an electrode of the second array, the transfer of charge via each of the electrodes of the first array is favored at the expense of the connection of these electrodes to said power supply means.

The best profit is thus derived from the charge of the capacitors and the duration of connection of the cells to the power supply means during the displaying of images is thus limited, thereby making it possible to substantially improve the efficiency of the device.

Preferably, each image to be displayed being divided into pixels or subpixels to which are allocated luminous intensity data, each cell of the panel being assigned to a pixel or subpixel of the images to be displayed, the device comprises means of processing this data so as to be able, during each sequence of connection of an electrode of the second array, to modulate the duration of connection $t'_{a1}$ of each electrode of the first array to said power supply means and to modulate the duration of transfer of charge $t'_{a2}$ of the intrinsic capacitors of the other cells linked to the same electrode of the first array, as a function of the luminous intensity datum of the cell powered between this electrode of the first array and this electrode of the second array.

Depending on the luminous intensity data to be processed, these processing means will therefore either modulate the duration of connection alone, or modulate the duration of charge transfer alone, or modulate both the duration of connection and the duration of charge transfer. Preferably, the duration $t'_{a2}$ of charge transfer is maximized and the duration $t'_{a1}$ of connection is minimized so as to best improve the efficiency of the device.

It is the duration of connection and/or the duration of transfer which are therefore modulated as a function of the luminous intensity data; thus, preferably, the display device according to the invention implements a pulse width modulation procedure. The control of the panel is therefore performed by modulating the duration of pulses or the width of electrical signals ("PWM" or Pulse Width Modulation"), as opposed to amplitude modulation ("PAM" or "Pulse Amplitude Modulation") as described for example in the document EP 1091340 already cited, or in the document U.S. Pat. No. 6,222,323.

Preferably, the drive means are adapted so that, during each sequence of connection of an electrode of the second array, the connection of each electrode of the first array to the power supply means is carried out, as appropriate, at the end of a sequence and the transfer of charges is carried out, as appropriate, at the start of a sequence. In this way, the recovery of capacitive energy is best ensured and is managed in a very simple manner.

Preferably, the device according to the invention is adapted so that:

if $t_L$ is the duration of each sequence of connection of an electrode of the second array, if $C_i$ is the mean value of the intrinsic capacitance of each cell, and if the second array has G electrodes, if $R_{EL}$ is the mean electrical resistance of an activated cell, we have: $G \times C_i > 40\% \times 0.2\ t_L/R_{EL}$.

It is for this type of panel that the capacitive energy then represents more than 40% on average of the energy consumed for the luminous emission of the cells and that the invention is then of greatest interest; in practice, the invention is of greatest interest when $G \cdot C_i \geqq 10$ nF, $R_{EL} \geqq 50$ kΩ, $t_L \leqq 500$ μs, this generally corresponding to the case of panels having electroluminescent organic cells.

Preferably, the device according to the invention is adapted so that:

if $t_L$ is the duration of each sequence of connection of an electrode of the second array, if $C_i$ is the mean value of the intrinsic capacitance of each cell, and if the second array has G electrodes, if $R_{EL}$ is the mean electrical resistance of an activated cell, the ratio $t_L/R_{EL} \cdot C_i$ is greater than 4.

This condition signifies that the discharge time of the intrinsic capacitors is much smaller than the line time, thereby allowing faster transfer and considerable recovery of capacitive energy; this condition moreover makes it possible to advantageously simplify the split between the "passive" powering of the cells by charge transfer and the traditional "active" powering by connection to the terminals of the power supply means.

Preferably, the cells of the panel are electroluminescent, and each comprise an organic electroluminescent layer; preferably, the thickness of this layer is less than or equal to 0.2 μm; a thickness as small as this entails high intrinsic capacitances and considerable charges which it is of particular interest to be able to transfer according to the invention.

BRIEF DESCRIPTION OF THE DRAWINGS

The invention will be better understood on reading the description which follows, given by way of nonlimiting example, and with reference to the appended figures in which.

The figures representing time charts take no account of any scale of values so as to better depict certain details which would not be clearly apparent if the proportions were complied with.

BRIEF DESCRIPTION OF THE PREFERRED EMBODIMENTS

Figure 1:
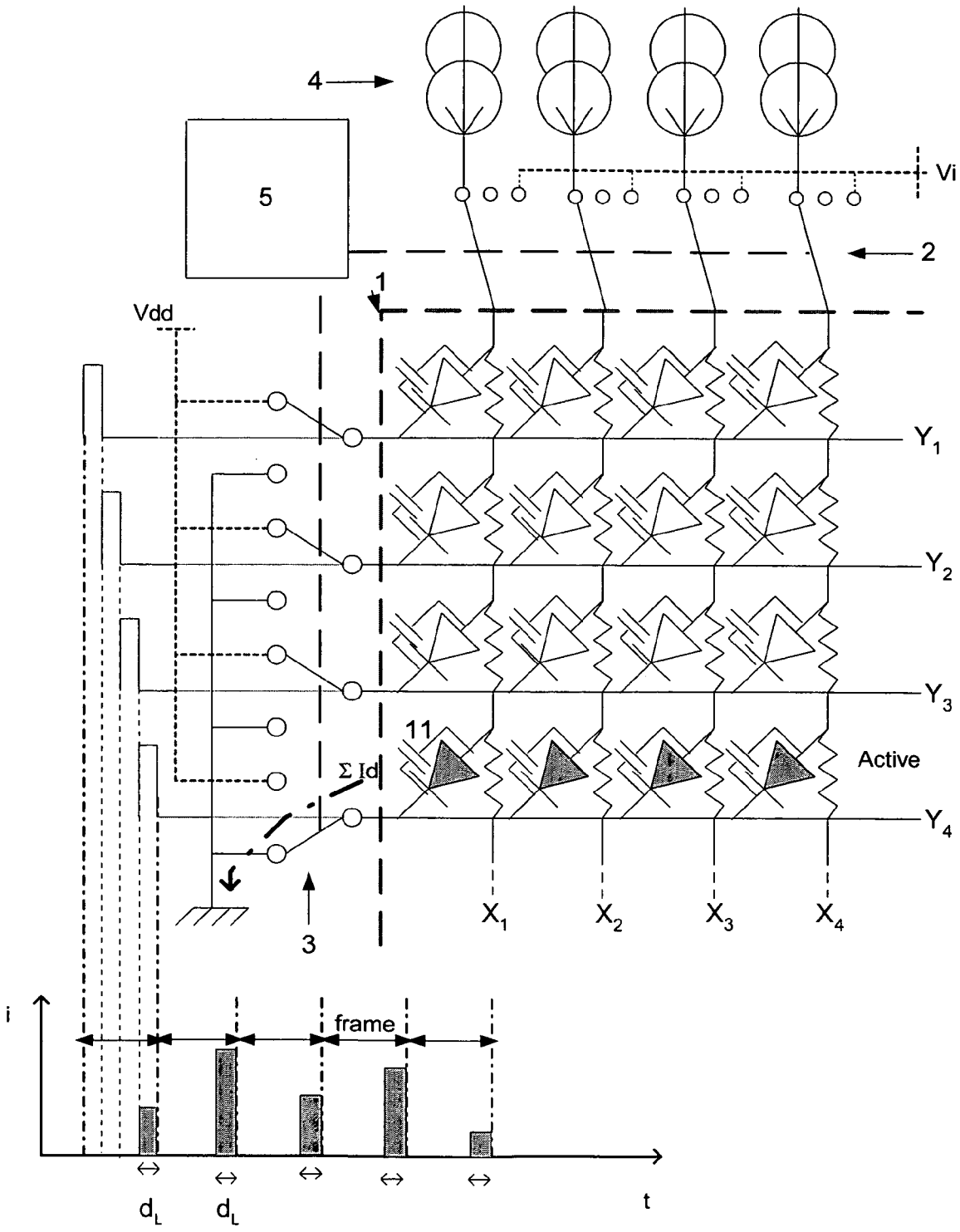
FIG. 1 describes a display device according to an embodiment of the invention.

With reference to FIG. 1, the display device according to the invention comprises:

- an image display panel 1 comprising an array X of anodes $X_1, X_2, X_3, X_4 \ldots$ arranged in columns and an array Y of cathodes arranged in rows $Y_1, Y_2, Y_3, Y_4 \ldots$ serving a two-dimensional array of electroluminescent cells 11, where each cell is powered between an anode (column) and a cathode (row).
- power supply means 4 comprising on the one hand anodic terminals and on the other hand cathodic terminals linked to earth (which is not represented),
- means of driving the cells from this panel comprising a set 2 of column drivers for controlling the link between the anodes and the anodic terminals, a set 3 of row drivers for controlling the link between the cathodes and the cathodic terminals (here via earth), and means 5 of driving these drivers,
- means of processing of data of the images to be displayed.

Figure 2:
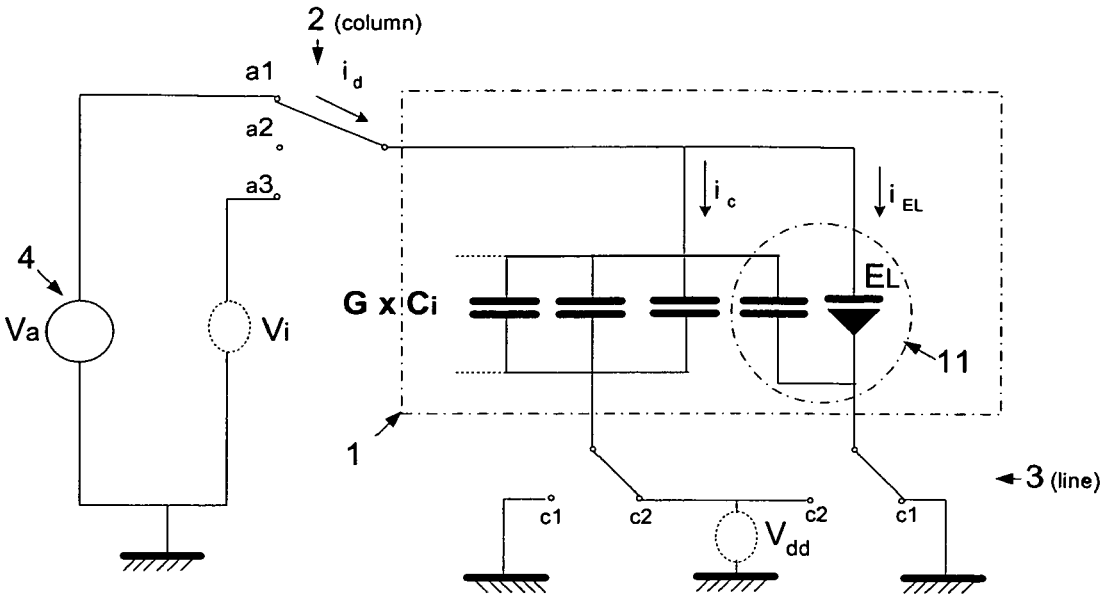
FIG. 2 represents a summary diagram of powering an electroluminescent cell of the device of FIG. 1.

With reference to FIG. 2, the row drivers 3 comprise two positions: a so-called activation position c1, of connection to earth where the corresponding row is therefore connected to the power supply means 4 via earth, and a so-called inactivation position c2 of connection to an inverse voltage generator Vdd; the purpose of this inverse voltage generator Vdd is to turn off those electroluminescent diodes of the panel to which it is connected; the voltage Vdd will therefore be chosen to be greater, in absolute value, than the voltage delivered by the power supply means 4 which are linked to the anodes in columns.

Each cell 11 of the panel comprises an electroluminescent organic layer (not represented) between the anode and the cathode which supply it with power; as this layer operates as a diode, it is represented by a diode EL in FIGS. 1 and 2; as represented in these figures, each cell comprises an intrinsic capacitor $C_i$ in parallel with this diode.

With reference to FIG. 2, each column driver 2 comprises three positions: the so-called activation position a1 where the column is connected to the power supply means 4 delivering a supply voltage $V_a$, the "unearthed" position a2 where the column is therefore "floating" and the so-called inactivation position a3 where the column is connected to a lower discharge limit generator $V_i$; the voltage $V_i$ will preferably be chosen to be slightly less than the threshold voltage $V_{th}$ defined hereinbelow, so that we have: $V_i=V_{th}-\epsilon$; conversely, if $V_i=0$, as will be seen later, the part $C_i \times V_{th}$ of the capacitive energy of the intrinsic capacitor of each cell is lost.

FIG. 2 represents a cell 11 in the active position powered by the power supply means 4 via a column driver 2 in position a1 and a row driver held in position c1 for the duration of scanning $t_L$ of this row; as shown in the figure, the row drivers of the other cells of the same column are in position c2 during this time; beyond this duration $t_L$, the row driver which was in position c1 passes to the inactivated position c2 while the driver of another row passes from the inactivated position c2 to the activated position c1.

If the image data assigned to this cell corresponds to a quantity of light $D_{EL}$, if $I_{EL}$ is the instantaneous electrical intensity in the electroluminescent diode EL, $D_{EL}$ is proportional to the quantity of electricity $Q_{EL}$ passing through the diode over the duration of scanning $t_L$ of the row of this cell so that we have $Q_{EL}=\int I_{EL}\,dt$, integrated over the duration $t_L$.

Figure 3:
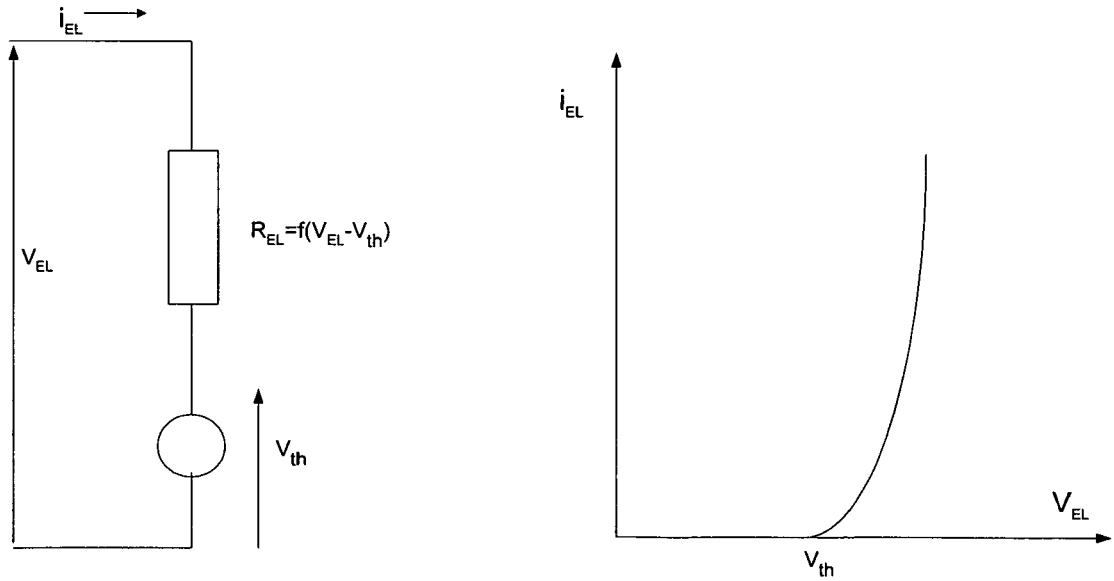
FIG. 3 represents the current-voltage characteristic of an electroluminescent diode corresponding to the cell of FIG. 2.

The current-voltage characteristic of an electroluminescent diode is illustrated in FIG. 3; to a first approximation, this curve may be represented by the equation $V_{EL}=V_{th}+R_{EL}\times I_{EL}$, where $V_{th}$ corresponds to a triggering threshold voltage and where $R_{EL}$ is the dynamic resistance of the diode.

The total electrical intensity $I_d$ injected into the cell 11 is equal to the sum of the intensity $i_{EL}$ passing through the diode of this cell and of the intensity $i_c$ passing through the set of intrinsic capacitors in parallel with the same anode as this cell 11, i.e. $G\times C_i$ if G is the number of rows, so that we have:

$$Q_{EL}=\int I_{EL}dt=\int I_d dt-\int I_c dt, \text{ integrated over the duration } t_L.$$

As illustrated in FIG. 2, $\int I_c\,dt$ corresponds to the quantity of charges stored in all the intrinsic capacitors $N\times C_i$ of the cells of the same column, between the start and the end of connection of the cell 11 to the power supply means; this quantity of charges is equal to the difference between the final charge at the end of connection $Q_{Cf}$ and the initial charge at the start of connection $Q_{Ci}$; we have $Q_{Cf}=G\cdot C_i\cdot V_a$, if however the time of connection to the power supply means is greater than the charging time of the capacitor (that is to say if $t_{a1}>3\tau$—see hereinbelow).

Only a part $Q_u$ of the charge of the intrinsic capacitors of the cells of this column can be used to allow the emission of a cell of the next row L' in the same column, since the diode of this cell is turned on only beyond the threshold voltage $V_{th}$; we therefore have: $Q_u=G\cdot C_i\,(V_C-V_{th})$, where $V_C$ is the voltage across the terminals of these intrinsic capacitors; at the end of the charging of these capacitors, we therefore have $Q_u=G\cdot C_i\,(V_a-V_{th})$.

If the column driver passes to the floating position a2, if the row driver passes to the inactivated position c2 while the driver of another row passes from position c2 to position c1, the intrinsic capacitors $G\cdot C_i$ discharge into the diode of the same column of this other row according to the equation:

$$V_C(t)=V_{th}+(V_a-V_{th})(\exp(-(t/R_{EL}\cdot G\cdot C_i))), \text{ where t corresponds to an instant of charge transfer.}$$

The time constant for the kinetics of the discharging of the intrinsic capacitors or for the transfer of charge to the diode therefore equals $\tau=R_{EL}\cdot G\cdot C_i$.

After a duration of $1\tau$, the intrinsic capacitors are discharged to 65%; after a duration of $2\tau$, the intrinsic capacitors are discharged to 85%; after a duration of $3\tau$, the intrinsic capacitors are discharged to 95%.

The display device here comprises a data table ("Look Up Table" or LUT) which lists the total charge transferred $Q_t(t_t)=\int_0^t Ci\cdot Vc(t)$ at each instant of transfer $t_t$ from the start of discharge.

At each scan of a row, the means of processing of data of the images to be displayed are adapted as specified hereinafter to deduce the durations of setting of each of the column drivers to position a1, a2 or a3, as a function of the luminous intensity data of the pixels or subpixels corresponding to the cells of this row.

The modulation of the luminous intensity emitted by each cell of the panel is here of the "PWM" type; the duration $t_c$ for which the column driver remains in the activated position a1 therefore depends on the luminous intensity datum $D_{EL}$ attributed to the cell 11; for this duration $t_c$, the electrical intensity in the cell is programmed to attain a constant value $I_p$; in practice, $t_c$ corresponds to a multiple of an elementary increment of duration $t_e$ which corresponds to the step size of the analog/digital converter used to code the luminous intensity datum $D_{EL}$ as a duration of connection; the value $Q_e=I_p \cdot t_e$ is called the elementary increment of charge.

A 6-bit converter is for example used, so that $t_L$ is divided into 64 increments of duration $t_e$ and that $t_c=N \cdot t_e$ where $0 \leqq N \leqq 64$.

At the end of a row scan, the part of charge $Q_u$ usable to supply a diode with power on the scanning of the next row therefore corresponds to a maximum number of transferable bits $N_a=Q_u/Q_e$.

Figure 4:
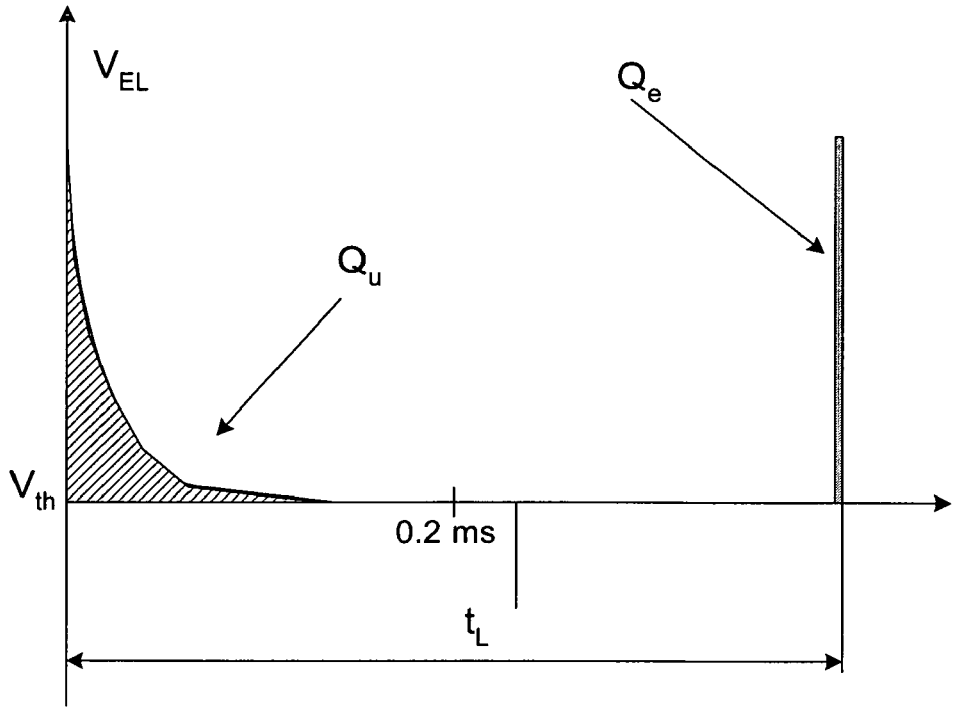
FIG. 4 represents the discharging of the intrinsic capacitance of the cell of FIG. 2, and the increment in charge corresponding to a time step of the analog/digital converter of the processing means of the device of FIG. 1.

FIG. 4 illustrates a comparison of the useful charge $Q_u$ of the intrinsic capacitor and of the charge increment $Q_e$.

If the image datum assigned to the cell of the next row in the same column corresponds to a quantity of light $D'_{EL}$ and to a quantity of electricity $Q'_{EL}$ which has to pass through the diode of this cell, we have:

$Q'_{EL}=Q'_a+Q_t$ where $Q'_a$ is the quantity of electricity possibly provided by the power supply means 4 for the duration $t'_{a1}$ of connection to the power supply means as a supplement to the quantity of electricity transferred of the connection time of the previous row $Q_t$, originating from the discharging of the intrinsic capacitors of the cells of the same column.

Figure 5:
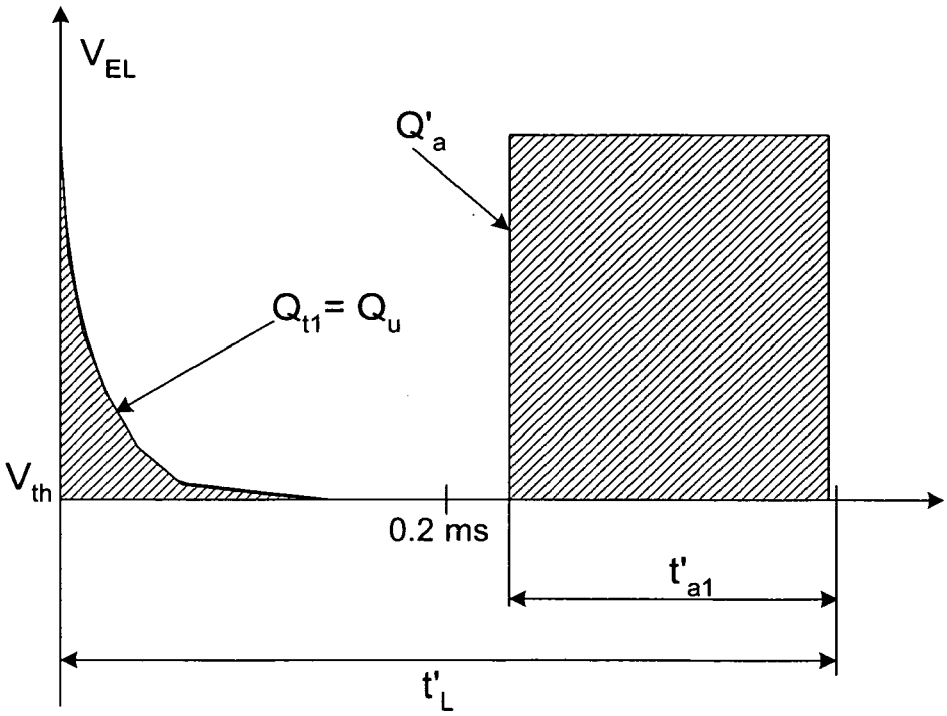
FIG. 5 represents the recovery of the capacitive energy for the benefit of a cell of the device of FIG. 1 which is thereafter actively powered so as to supplement the charge required, without the recovery period and the active power supply period overlapping.
Figure 6:
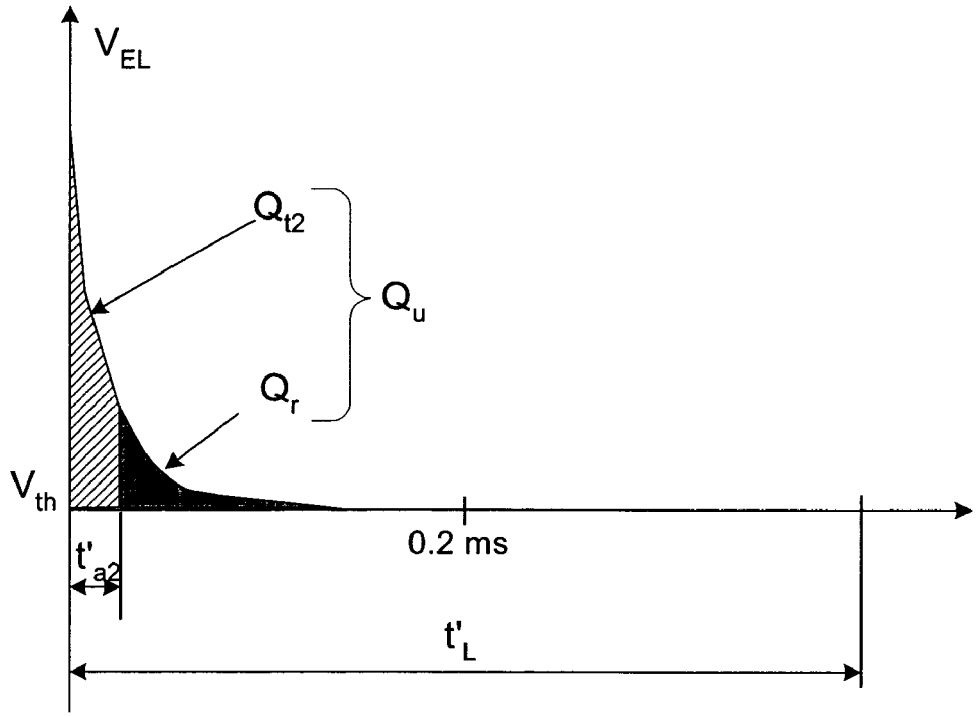
FIG. 6 represents the partial and adapted recovery of the capacitive energy for the benefit of a cell of the device of FIG. 1 which is not thereafter actively powered.

Two cases may be distinguished:

either $Q_u \leqq Q'_{EL}$, that is to say the quantity of electricity $Q'_{EL}$ required in the diode exceeds the usable charge of the previous row; we then have $Q'_a \geqq 0$; the quantities of electricity passing through the diode are then split in accordance with FIG. 5 between a duration of passive powering which corresponds to the discharging $Q_{t1}$ of the intrinsic capacitors of the connection time of the previous row and a duration $t'_{a1}$ of flow of the power supply 4; during the passive powering, the column driver is in the floating position a2; during the active powering, the column driver is in the active position a1;

or $Q_u > Q'_{EL}$, that is to say the usable charge of the previous row exceeds the quantity of electricity $Q'_{EL}$ required in the diode; we then have $Q'_a=0$; with reference to FIG. 6, the column driver is in the floating position a2 for a duration $t'_{a2}$ until the intrinsic capacitors of the connection time of the previous row discharge by a value $Q_{t2}=Q'_{EL}$, the residual charge $Q_r=Q_u-Q'_{EL}$ being dissipated toward earth via the column driver which for this purpose is set to the deactivated position c3.

The manner in which the means for processing data of images are adapted for deducting the durations for which each of the column drivers is set to position a1, a2 or a3 as a function of the luminous intensity data of the pixels or subpixels corresponding to the cells of the activated row will now be described.

These means are adapted for transmitting to each column driver:

the value "true" or "false" of the inequality $Q_u \leqq Q'_{EL}$, if this inequality is "true" (case 1), the number $N'_{a1}$ of increments of duration $t_e$ is such that $t'_{a1}=N'_{a1} \cdot t_e$;

if this inequality is "false" (case 2), the number $N'_{a2}$ of increments of duration $t_e$ is such that $t'_{a2}=N'_{a2} \cdot t_e$.

The durations $t'_{a1}$ and $t'_{a2}$ are the durations for which the column driver of the cell is held respectively in position a1 and in position a2.

In case 1 where $Q_u \leqq Q'_{EL}$, we calculate $N'_{a1}$ as follows:

We calculate the parameter $N'_a=(Q'_{EL}-Q_u)/Q_e$;

If $N'_a \cdot t_e+3\tau \leqq t'_L$ as illustrated in FIG. 5, then there is no overlap between the duration of passive power supply by transfer of charge of the connection time of the previous row and the duration $t'_{a1}$ of active power supply, and $N'_{a1}=N'_a$; the charge actually transferred $Q'_t$ will then be equal to $Q_u$; the column driver is then held in position a2 for a duration $t_L-N'_{a1} \cdot t_e$, then in position a1 for a duration $N'_{a1} \cdot t_e$; it is not therefore necessary for the driver to pass through the position a3.

Figure 7:
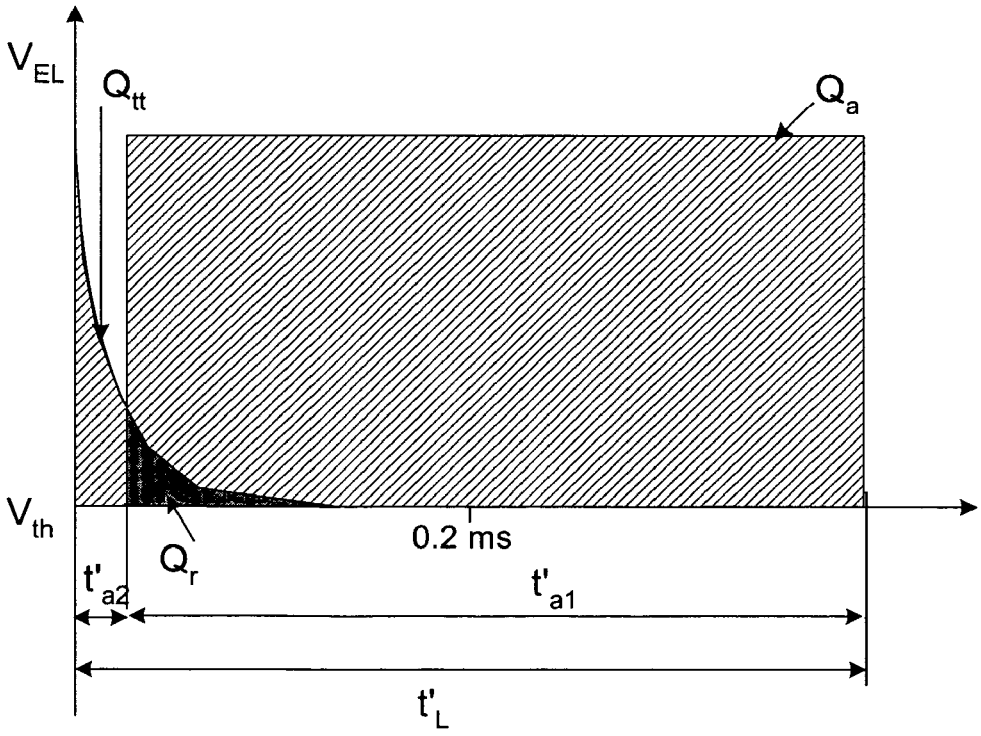
FIG. 7 represents the partial recovery of the capacitive energy for the benefit of a cell of the device of FIG. 1 which is thereafter actively powered so as to supplement the charge required, in the case where the recovery period and the active power supply period overlap.

If $N'_a \cdot t_e+3\tau > t'_L$ as illustrated in FIG. 7, then there is an overlap between the duration of passive power supply $t'_{a2}$ of the cell and the duration of active power supply $t'_{a1}$; the charge actually transferred $Q'_t$ will then be less than $Q_u$; specifically, the charge transfer will be limited by the time $t'_L-N'_{a1} \cdot te<3\tau$.

By using the data table (LUT) described previously, it is possible to ascertain the charge transferred at each instant of transfer $t_t$ from the start of discharge, that is to say $Q'_t-f(t_t)$.

We thus look for the transfer time $t'_{a2}$ such that $Q'_{EL}=f(t'_{a2})+Q_e(t'_L-t'_{a2})/t_e$ and from this we deduce $N'_{a1}=(t'_L-t_{a2})/t_e$.

The column driver is then held in position a2 for a duration $t'_{a2}$, then in position a1 for a duration $t'_{a1}=N'_{a1} \cdot t_e=t'_L-t'_{a2}$.

In case 2 where $Q_u > Q'_{EL}$ illustrated by FIG. 6, we calculate $N'_{a2}$ as follows:

Using the data table (LUT) described previously, it is possible to ascertain the charge transferred at each instant of transfer $t_t$ from the start of discharge, that is to say $Q'_t-f(t_t)$.

We then look for the transfer time $t_{a2}$ such that $Q'_{EL}=f(t'_{a2})$.

We deduce $N'_{a2}=t'_{a2}/t_e$.

The column driver is then held in position a2 for a duration $t_{a2}$, then in position a3 for the duration $t'_L-t_{a2}$.

In the scheme for driving the panel just described, the charging time of the intrinsic capacitors was considered to be appreciably less than the discharge time $\tau=R_{EL} \cdot G \cdot C_i$, for each column of the panel; specifically, the charging time$=R_{GEN} \cdot G \cdot C_i$, where $R_{GEN}$ is the internal resistance of the power supply means 4, to which should be added here the self resistance of a column electrode which is no longer negligible compared with this internal resistance; as $R_{GEN}$ generally equals from 1 to 5 kΩ and is much less than $R_{EL}$ (67 kΩ in the example hereinbelow), the charging time of the intrinsic capacitors is actually appreciably less than the discharge time of these capacitors.

We have therefore seen how the image data processing means make it possible to deduce the durations for which each of the column drivers is set to position a1, a2 or a3 as a function of the luminous intensity data of the pixels or subpixels corresponding to the cells of an activated row L', and as a function of the usable charge $Q_u$ originating from the previous row L.

Thus, during each sequence of connection of a row electrode, the duration of connection $t'_{a1}$ of each column electrode and/or the duration of charge transfer $t'_{a2}$ via said column electrode are/is modulated as a function of the luminous intensity datum of the cell powered between this electrode of the first array and this electrode of the second array. More precisely, it may be seen that, during each sequence of connection of a row electrode, the connection of each column electrode to the power supply means is carried out, as appropriate, at the end of the sequence for the duration $t'_{a1}$ and the transfer of charge is carried out, as appropriate, at the start of the sequence.

By virtue of this procedure for driving the panel, a larger share of the capacitive energy of the intrinsic capacitors of the cells of the panel is recovered than in the prior art, the recovery of capacitive energy is managed in a very simple manner, and the efficiency of the display device is more substantially improved.

The embodiment just described relates therefore to passive panels of OLED type; this embodiment is applicable in particular to color screens comprising around G=50 lines, where each cell or subpixel exhibits a size of 100 μm×300 μm and where, by way of indication:

| | |
|---|---|
| $V_{th}$ threshold voltage of OLED: | 4 V |
| Current density for emission at 100 cd/m$^2$: | 0.4 mA/cm$^2$ mean |
| Line current density on 0.4 × 50: | 200 mA/cm$^2$ |
| OLED operating voltage at 200 mA/cm$^2$ | 8 V |
| OLED mean resistance per unit area (4 V − $I_{EL}$ = 200 mA): | 20 Ω/cm$^2$ |
| → $R_{EL}$: dynamic resistance of a diode: | (20/0.03 × 0.01) = 67 kΩ |
| Intrinsic capacitance per cm$^2$ of panel: | 56 nF/cm$^2$ |
| → G · $C_i$ then equals: | (56 × 0.01 × 0.03 × 50) = 0.84 nF |
| → τ = $R_{EL}$ · G · $C_i$ then equals | 56 μs |

If the time of an image frame is 20 ms, the activation time $t_L$ of each line then equals 20 ms/50=0.4 ms.

With the aid of these values, we can evaluate the mean capacitive energy which could be recovered with regard to the electrical energy dissipated in the electroluminescent organic diodes, if it is considered that on average, over a video sequence to be displayed, only 20% of the diodes are lit:

the quantity of electricity necessary for the charging of a column of the panel is 4 V×0.84 nF=3.36 nC, the quantity of electricity G. $Q_{EL}$ required for the powering of a cell of the same column of the panel for 20% of the time of a connection time $t_L$=400 μs of a line equals: 4 V×0.2×400 μs/67 kΩ=4.776 nC.

In the absence of capacitive energy recovery, a cell of the panel would therefore consume 8.136 nC; even though the invention allows the recovery of only a share of this capacitive energy, one does advantageously manage to decrease the consumption of the panel by 25%.

The invention is of significant interest once the capacitive energy represents more than 40% of the energy consumed by a diode, hence once $G \times C_i > 40\% \times 0.2\ t_L/R_{EL}$.

Moreover, it is noted that the ratio $t_L/\tau$ equals 7.15; it is therefore seen that the discharge time 3τ=168 μs is appreciably less than the row activation time $t_L$=400 μs, thereby making it possible here to recover a very considerable share of the capacitive energy; to obtain a recovery, it is in practice important for the ratio $t_L/R_{EL} \cdot C_i$ to be greater than 4.

The embodiment as described presents the case where the instant of the end of connection of the cells to the power supply means (column driver in position a1) corresponds to the instant of the end of connection of the active row (row driver in position c1); the invention applies also to cases where this instant of the end of position a1 of the column driver precedes the instant of the end of position c1 of the row driver, provided that the values of $t'_{a1}$ and $t'_{a2}$ so permit.

The embodiment just described presents the case where the modulation of intensity of emission of the cells is carried out by pulse width modulation; the invention applies also to display devices employing pulse amplitude modulation.

The invention applies also to panels whose electroluminescent layers are not organic.

The invention claimed is:

1. A device for displaying images comprising:

an image display panel configured such that each image to be displayed is divided into pixels or subpixels having luminous intensity data allocated thereto, said image display panel comprising a first array and a second array of electrodes which serve an array of light-emitting cells, where each light-emitting cell is assigned to a pixel or subpixel of images to be displayed and is powered for light emission between an electrode of the first array and an electrode of the second array effecting between them an intrinsic capacitor $C_i$, power supply means for generating a potential difference between two terminals, and drive means:

wherein successively connecting each electrode of the second array to one of the terminals of the power supply means, wherein, during each sequence of connection of an electrode of the second array, simultaneously connecting one or more or all the electrodes of the first array to the other terminal of the power supply means in order to allow said power supply means to power for light emission at least one of the light-emitting cells linked both to the respective electrode of the second array and the respective electrode or electrodes of the first array, wherein, during the sequence of connection of an electrode of the second array, transferring to each light-emitting cell to be powered for light emission charge of the intrinsic capacitors of the other light-emitting cells that are linked to the same electrode of the first array as the light-emitting cell to be powered in order to allow said transferred charge to power for light emission said light-emitting cell, wherein said charge has been accumulated during a just preceding sequence of connection of another electrode of the second array, and wherein during each sequence of connection of an electrode of the second array, the duration of connection $t'_{a1}$ of each electrode of the first array to said power supply means and the duration of the transfer of charge $t'_{a2}$ of the intrinsic capacitors of the other light-emitting cells linked to the same electrode of the first array are made dependent on a comparison of the luminous intensity datum of the light-emitting cell that is to be powered for light emission between this electrode of the first array and this electrode of the second array with the useful charge $Q_u$ that has been accumulated during a just preceding sequence of connection of another electrode of the second array.

2. The device as claimed in claim 1, wherein the drive means are adapted so that, during each sequence of connection of an electrode of the second array, the transfer of charge via each of the electrodes of the first array is favored at the expense of the connection of these electrodes to said power supply means.

3. The device as claimed in claim 1, wherein the drive means are adapted so that, during each sequence of connection of an electrode of the second array, said connection of each electrode of the first array to said power supply means is carried out, as appropriate, at the end of a sequence and said transfer of charges is carried out, as appropriate, at the start of a sequence.

4. The device as claimed in claim 1, wherein it is adapted so that:

if $t_L$ is the duration of each sequence of connection of an electrode of the second array, if $C_i$ is the mean value of the intrinsic capacitance of each light-emitting cell, and if the second array has G electrodes, if $R_{EL}$ is the mean electrical resistance of an activated light-emitting cell, we have: $G \times C_i > 40\% \times 0.2 t_L/R_{EL}$.

5. The device as claimed in claim 1, wherein it is adapted so that:

if $t_L$ is the duration of each sequence of connection of an electrode of the second array, if $C_i$ is the mean value of the intrinsic capacitance of each light-emitting cell, and if the second array has G electrodes, if $R_{EL}$ is the mean electrical resistance of an activated light-emitting cell, the ratio $t_L/R_{EL} \cdot C_i$ is greater than 4.

6. The device as claimed in claim 1, wherein said light-emitting cells are electroluminescent.

7. The device as claimed in claim 6, wherein each light-emitting cell comprises an organic electroluminescent layer.

8. The device as claimed in claim 7, wherein the thickness of said layer is less than or equal to 0.2 μm.

* * * * *